US009422501B2

(12) United States Patent
Yagishita

(10) Patent No.: US 9,422,501 B2
(45) Date of Patent: Aug. 23, 2016

(54) LUBRICATING OIL COMPOSITION AND METHOD FOR LUBRICATING SLIDING MATERIAL WHILE PREVENTING ELUTION OF COPPER AND LEAD

(71) Applicant: JX Nippon Oil & Energy Corporation, Tokyo (JP)

(72) Inventor: Kazuhiro Yagishita, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 14/416,954

(22) PCT Filed: Jun. 7, 2013

(86) PCT No.: PCT/JP2013/065819

§ 371 (c)(1),
(2) Date: Jan. 23, 2015

(87) PCT Pub. No.: WO2014/017182

PCT Pub. Date: Jan. 30, 2014

(65) Prior Publication Data

US 2015/0203780 A1 Jul. 23, 2015

(30) Foreign Application Priority Data

Jul. 27, 2012 (JP) ..... 2012-167686
Jul. 27, 2012 (JP) ..... 2012-167687
Jul. 27, 2012 (JP) ..... 2012-167688

(51) Int. Cl.

| | |
|---|---|
| ***C10M 133/40*** | (2006.01) |
| ***C10M 141/10*** | (2006.01) |
| ***C10M 169/04*** | (2006.01) |
| ***C10M 133/12*** | (2006.01) |
| ***C10M 141/12*** | (2006.01) |

(52) U.S. Cl.

CPC ..... *C10M 133/40* (2013.01); *C10M 141/10* (2013.01); *C10M 141/12* (2013.01); *C10M 2203/1025* (2013.01); *C10M 2207/026* (2013.01); *C10M 2207/262* (2013.01); *C10M 2209/084* (2013.01); *C10M 2215/04* (2013.01); *C10M 2215/044* (2013.01); *C10M 2215/064* (2013.01); *C10M 2215/221* (2013.01); *C10M 2215/223* (2013.01); *C10M 2215/28* (2013.01); *C10M 2219/068* (2013.01); *C10M 2223/04* (2013.01); *C10M 2223/042* (2013.01); *C10M 2223/043* (2013.01); *C10M 2223/045* (2013.01); *C10N 2210/06* (2013.01); *C10N 2230/04* (2013.01); *C10N 2230/10* (2013.01); *C10N 2230/12* (2013.01); *C10N 2230/52* (2013.01)

(58) Field of Classification Search

CPC ..... C10M 133/40; C10M 141/10; C10M 141/12; C10M 2203/1025; C10M 2207/026; C10M 2207/262; C10M 2209/084; C10M 2215/04; C10M 2215/044; C10M 2215/064; C10M 2215/221; C10M 2215/223; C10M 2215/28; C10M 2219/068; C10M 223/04; C10M 223/042; C10M 223/043; C10M 223/0452; C10N 2210/06; C10N 2230/04; C10N 2230/10; C10N 2230/12; C10N 2230/52

USPC ..... 508/262, 431, 432, 563, 584

See application file for complete search history.

(56) References Cited

U.S. PATENT DOCUMENTS

| | | | | |
|---|---|---|---|---|
| 5,073,278 | A * | 12/1991 | Schumacher | C10M 133/02 508/262 |
| 5,198,130 | A | 3/1993 | Schumacher | |
| 2008/0020952 | A1* | 1/2008 | Yagishita | C10M 139/00 508/186 |
| 2008/0274922 | A1 | 11/2008 | Yagishita | |

FOREIGN PATENT DOCUMENTS

| | | | |
|---|---|---|---|
| CA | 2020552 | A1 | 1/1991 |
| CA | 2020558 | C | 11/2001 |
| JP | S60-28496 | A | 2/1985 |
| JP | H03-45695 | A | 2/1991 |
| JP | H03-45696 | A | 2/1991 |
| JP | H04-309597 | A | 11/1992 |
| JP | H07-268379 | A | 10/1995 |
| JP | 2009-197135 | A | 9/2009 |
| WO | 2006043606 | A1 | 4/2006 |
| WO | 2008109502 | A1 | 9/2008 |
| WO | 2008109523 | A1 | 9/2008 |

OTHER PUBLICATIONS

STIC Structure Search Results for compounds HALS1, HALS2, and HALS3.*

Int'l Search Report issued Sep. 10, 2013 in Int'l Application No. PCT/JP2013/065819.

Extended Search Report issued Dec. 22, 2015 in EP Application No. 13823119.6.

* cited by examiner

*Primary Examiner* — James Goloboy

(74) *Attorney, Agent, or Firm* — Panitch Schwarze Belisario & Nadel LLP

(57) ABSTRACT

The present invention provides a lubricating oil composition having excellent NOx resistance, anti-oxidation properties, base number retainability and detergency, suitably used for an internal combustion engine. The lubricating oil composition comprises a lubricating base oil, (A) a 2,2,6,6-tetraalkylpiperidine derivative and (B) an organic molybdenum compound and/or an organic tungsten compound and preferably further comprises (C) a hindered phenol-type anti-oxidant and/or an aromatic amine-type anti-oxidant or (D) at least one type of compound selected from the group of consisting of phosphorus compounds and metal salts or amine salts. Furthermore, the present invention also provides a method for lubricating a sliding material by contacting a specific lubricating oil composition selected from the above lubricating oil compositions with the sliding material while preventing elution of the copper and lead contained in the material.

9 Claims, No Drawings

LUBRICATING OIL COMPOSITION AND METHOD FOR LUBRICATING SLIDING MATERIAL WHILE PREVENTING ELUTION OF COPPER AND LEAD

CROSS-REFERENCE TO RELATED APPLICATION

This application is a Section 371 of International Application No. PCT/JP2013/065819, filed Jun. 7, 2013, which was published in the Japanese language on Jan. 30, 2014, under International Publication No. WO 2014/017182 A1, and the disclosure of which is incorporated herein by reference.

TECHNICAL FIELD

The present invention relates to novel lubricating oil compositions, and to a lubricating oil composition having excellent NOx resistance, anti-oxidation properties, base number retainability and detergency. In particular, the present invention relates to a lubricating oil composition suitably used for an internal combustion engine.

The present invention also relates to a method for lubricating a sliding material using a specific lubricating oil composition selected from the above lubricating oil compositions while preventing elution of the copper and lead contained in the material. Specifically, the present invention relates to a method for lubrication to prevent the copper and lead of a copper- and/or lead-containing sliding material from being corroded by preventing elution of the copper and lead and to a method for lubrication particularly suitable for an internal combustion engine having copper- and/or lead-containing sliding materials.

BACKGROUND ART

Conventionally, lubricating oil has been used in an internal combustion engine, a transmission or the like to facilitate the smooth operation thereof. In particular, a lubricating oil (engine oil) for an internal combustion engine is required to have a high level of performances because the internal combustion engine has been improved in performance, enhanced in output and used under severe working conditions. Therefore, conventional engine oils have been blended with various additives such as antiwear agents, metallic detergents, ashless dispersants, and anti-oxidants to meet such requisite performances. Since an engine oil contacts peroxides that are active species of oxidation degradation at piston-cylinder regions, it has been required to have excellent oxidation resistivity. Phenol- or amine-based anti-oxidants and zinc dialkyldithiophosphate (ZDTP) acting as a peroxide decomposer have, therefore, been used in an engine oil so as to enhance the oxidation stability thereof. The use of a molybdenum compound as a peroxide decomposer is also known. Whilst, it is also conventionally known to blend an hindered amine (for example, see Patent Literatures 1 and 2) and also known to blend a phenol-based anti-oxidant, or zinc dialkyldithiophosphate and hindered amine (for example, see Patent Literatures 3 to 5) in order to enhance the oxidation stability of a lubricating oil. However, it is not known to blend a hindered amine compound, and an organic molybdenum compound and further a phenol-based anti-oxidant at the same time so as to enhance the NOx resistance.

Iron-based materials and aluminum-based materials are mainly used as sliding materials, but aluminum-, tin-, copper- and/or lead-containing materials are sometimes used for the main bearing or con rod bearing of an internal combustion engine. Among these materials, lead-containing materials have excellent characteristics that they are less in fatigue phenomenon but have a drawback that they are large in corrosion wear. It is known that such corrosion is caused by accumulation of peroxide due to deterioration of the oil or oxidization directly by molecular oxygen in the air and also known that oxidation products such as quinone, diacetyl, nitrogen oxide, nitro compounds or the like facilitate corrosion in case of coexistence with acid.

Actual corrosion is complicated because it is governed by many factors, but for corrosion prevention, it is generally important to prevent oxidation of a lubricating oil, destroy oxidizing substances, prevent generation of anti-corrosive oxidation products, deactivate acidic substances and form anti-corrosive film on metal surfaces. As a more specific method for preventing corrosion, it is known to add to a lubricating oil an additive having functions as a peroxide decomposer and an anti-corrosive film forming agent such as zinc dithiophosphate or sulfide, an amine- or phenol-based chain terminating type anti-oxidant, an anti-corrosive film forming agent such as benzotriazole, and a detergent dispersant such as acid neutralizer, and most of these four types of components are used in combination.

In particular, for corrosion wear prevention of lead-containing sliding materials, sulfur-containing antiwear agents such as zinc dithiophosphate are extremely effective, and for example, a conventional engine oil blended with zinc dithiophosphate can perform a peroxide decomposition effect together with excellent lead corrosion wear prevention due to deactivation of lead surfaces (for example, see Patent Literature 6).

Whilst, a sulfur-containing compound such as zinc dithiophosphate is likely to cause sulfide corrosion with respect to sliding materials containing non-ferrous base metals other than lead (for example, copper, tin, silver and the like), and although corrosion inhibitors such as benzotriazole is effective in corrosion prevention of copper, it has been found that the sulfur-containing compound does not exhibit sufficient effects in preventing corrosion of lead. That is, it was impossible to prevent elution of copper and/or lead with prior art techniques.

CITATION LIST

Patent Literature

Patent Literature 1: Japanese Patent Application Laid-Open Publication No. 60-28496

Patent Literature 2: Japanese Patent Application Laid-Open Publication No. 3-45695

Patent Literature 3: Japanese Patent Application Laid-Open Publication No. 3-45696

Patent Literature 4: Japanese Patent Application Laid-Open Publication No. 4-309597

Patent Literature 5: Japanese Patent Application Laid-Open Publication 2009-197135

Patent Literature 6: Japanese Patent Application Laid-Open Publication No. 07-268379

SUMMARY OF INVENTION

Technical Problem

The present invention has an object to provide lubricating oil compositions having excellent NOx resistance, oxidation stability, base number retainability (long-drain properties) and detergency, suitably used particularly for an internal combustion engine. The present invention also has an object to provide a method for lubricating a sliding material to prevent elution of copper and/or lead using a specific lubricating oil composition selected from the foregoing lubricating oil compositions.

Solution to Problem

The present invention has been accomplished as the results of extensive studies to achieve the above object.

That is, the present invention relates a lubricating oil composition comprising a lubricating base oil, (A) a 2,2,6,6-tetraalkylpiperidine derivative and (B) an organic molybdenum compound and/or an organic tungsten compound.

The present invention also relates to the lubricating oil composition further comprising (C) a hindered phenol-type anti-oxidant and/or an aromatic amine-type anti-oxidant.

The present invention also relates to the lubricating oil composition further comprising (D) at least one type of compound selected from the group of consisting of phosphorus compounds represented by formula (1) and metal salts or amine salts thereof in an amount of 0.005 to 0.5 percent by mass as phosphorus:

(1)

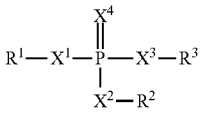

wherein $X_1$, $X_2$, $X_3$ and $X_4$ are each independently oxygen or sulfur and at least two of them are oxygen, and $R_1$, $R_2$ and $R_3$ are each independently hydrogen or a hydrocarbon group having 1 to 30 carbon atoms.

The present invention also relates to the lubricating oil composition wherein Component (D) is a sulfur-free phosphorus acid ester metal salt represented by formula (2) and/or formula (3):

(2)

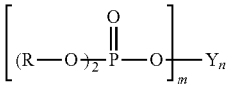

(3)

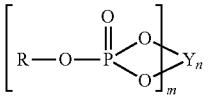

wherein Rs are each an alkyl or aryl group having 1 to 30 carbon atoms and may be the same or different from each other, Y is metal excluding alkali metal, and m and n are each independently an integer of 1 to 4.

The present invention also relates to a method for lubricating a sliding material while preventing elution of the copper and/or lead contained in the material, comprising contacting a lubricating oil composition comprising a lubricating base oil, (A) a 2,2,6,6-tetraalkylpiperidine derivative, (B) an organic molybdenum compound in an amount of 30 to 300 ppm by mass as molybdenum and (C) a hindered phenol-type anti-oxidant and/or an aromatic amine-type anti-oxidant with a copper- and/or lead-containing sliding material.

The present invention also relates to the method for lubrication wherein the lubricating oil composition further comprises (D) at least one type of compound selected from the group of consisting of phosphorus compounds represented by formula (1) and metal sa is or amine salts thereof in an amount of 0.005 to 0.5 percent by mass as phosphorus:

(1)

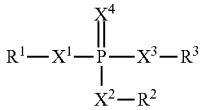

wherein $X^1$, $X^2$, $X^3$ and $X^4$ are each independently oxygen or sulfur and at least two of them are oxygen and $R^1$, $R^2$ and $R^3$ are each independently hydrogen or a hydrocarbon group having 1 to 30 carbon atoms.

The present invention also relates to the method for lubrication wherein Component (D) is a sulfur-free phosphorus acid ester metal salt represented by formula (2) and/or formula (3):

(2)

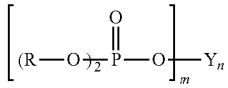

(3)

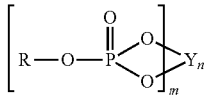

wherein Rs are each an alkyl or aryl group having 1 to 30 carbon atoms and may be the same or different from each other, Y is metal excluding alkali metal, and m and n are each independently an integer of 1 to 4.

Advantageous Effect of Invention

The lubricating oil composition of the present invention has excellent NOx resistance, oxidation stability, base number retainability (long-drain properties) and detergency, suitably used particularly for an internal combustion engine. The method for lubrication of the present invention using a specific lubricating oil composition selected from the lubricating oil compositions of the present invention can prevent elution of both copper and lead and thus is used particularly suitably for an internal combustion engine having copper- and/or lead-containing sliding materials.

DESCRIPTION OF EMBODIMENTS

The present invention will be described below.

Examples of the lubricating base oil of the lubricating oil composition of the present invention (hereinafter referred to as "lubricating base oil of the present invention") include mineral base oils and/or synthetic base oils.

Examples of the mineral base oil include paraffinic mineral base oils which can be produced by subjecting a lubricating oil fraction produced by atmospheric- and/or vacuum-distillation of a crude oil, to any one of or any suitable combination of refining processes selected from solvent deasphalting, solvent extraction, hydrocracking, hydroisomerizing, solvent dewaxing, catalytic dewaxing, hydrorefining, sulfuric acid treatment, and clay treatment; n-paraffin base oils; and iso-paraffin base oils.

Examples of preferred lubricating base oils include base oils produced by refining the following base oils (1) to (7) and/or lubricating oil fractions recovered therefrom in a given refining process to recover lubricating oil fractions:

(1) a whole vacuum gas oil (WVGO) produced by vacuum distillation of the topped crude of a paraffin-base crude oil and/or a mixed-base crude oil;

(2) a wax produced by dewaxing of lubricating oil (slack wax) and/or a synthetic wax produced through a gas to liquid (GTL) process (Fischer-Tropsch wax, GTL wax);

(3) a mixed oil of one or more types selected from the above base oils (1) and (2) or an oil produced by mild-hydrocracking the mixed oil;

(4) a mixed oil of two or more base oils selected from (1) to (3) above;

(5) a deasphalted oil (DAO) produced by deasphalting a vacuum residue of a topped crude of a paraffin-base crude oil and/or a mixed-base crude oil;

(6) an oil produced by mild-hydrocracking (MHC) the base oil (5);

(7) a mixed oil of two or more base oils selected from (1) to (6) above.

The above-mentioned given refining process is preferably hydrorefining such as hydrocracking or hydrofinishing, solvent refining such as furfural extraction, dewaxing such as solvent dewaxing and catalytic dewaxing, clay refining with acidic clay or active clay, or chemical (acid or alkali) refining such as sulfuric acid treatment and sodium hydroxide treatment. In the present invention, any one or more of these refining processes may be used in any combination and any order.

The mineral base oil is particularly preferably the following base oil (8):

(8) a hydrocracked mineral oil produced by hydrocracking a base oil selected from the base oils (1) to (7) or a lubricating oil fraction recovered therefrom, and subjecting the resulting product or a lubricating oil fraction recovered therefrom by distillation, to a dewaxing treatment such as solvent or catalytic dewaxing, optionally followed by distillation.

If necessary, a solvent refining process and/or hydrofinishing process may be additionally carried out at appropriate timing upon production of the above lubricating base oil (8).

No particular limitation is imposed on the sulfur content of the mineral base oil, which is, however, preferably 100 ppm by mass or less, more preferably 50 ppm by mass or less, more preferably 10 ppm by mass or less, particularly preferably 5 ppm by mass or less with the objective of further enhancement in thermal oxidation stability and reduction in sulfur content.

The % $C_A$ of the mineral base oil is preferably 2 or less, more preferably 1 or less, more preferably 0.8 or less, particularly preferably 0.5 or less, most preferably 0. If the % $C_A$ exceeds 2, the viscosity-temperature characteristics, thermal oxidation stability and fuel saving properties tends to deteriorate.

Examples of synthetic base oils include poly-α-olefins and hydrogenated compounds: thereof; isobutene oligomers and hydrogenated compounds thereof; isoparaffins; alkylbenzenes; alkylnaphthalenes; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol 2-ethylhexanoate and pentaerythritol pelargonate; polyoxyalkylene glycols; dialkyldiphenyl ethers; and polyphenyl ethers. Preferred synthetic lubricating base oils are poly-α-olefins. Typical examples of poly-α-olefins include oligomers or cooligomers of α-olefins having 2 to 32, preferably 6 to 16 carbon atoms, such as 1-octene oligomer, decene oligomer, ethylene-propylene cooligomer, and hydrogenated compounds thereof.

The viscosity index of the lubricating base oil used in the present invention is preferably 100 or greater, more preferably 110 or greater, more preferably 120 or greater and 100 or less. If the viscosity index is less than 110, not only the viscosity-temperature characteristics, thermal oxidation stability and anti-evaporation properties would be deteriorated but also the friction coefficient tends to increase and the anti-wear properties tends to deteriorate. If the viscosity index exceeds 160, the low temperature viscosity characteristics tend to deteriorate.

The viscosity index referred herein denotes the viscosity index measured in accordance with JIS K 2283-1993.

The 100° C. kinematic viscosity of the lubricating base oil used in the present invention is preferably 10 $mm^2/s$ or lower, more preferably 6 $mm^2/s$ or lower, more preferably 5.0 $mm^2/s$ or lower, particularly preferably 4.5 $mm^2/s$ or lower, most preferably 4.2 $mm^2/s$ or lower. Whilst, the kinematic viscosity is preferably 1 $mm^2/s$ or higher, more preferably 1.5 mm2/s or higher, more preferably 2 $mm^2/s$ or higher, particularly preferably 2.5 $mm^2/s$ or higher, most preferably 3 $mm^2/s$ or higher. The 100° C. kinematic viscosity referred herein denotes the 100° C. kinematic viscosity defined by ASTM D-445. If the 100° C. kinematic viscosity of the lubricating base oil component exceeds 10 $mm^2/s$, the low temperature viscosity characteristics are deteriorated and sufficient fuel saving properties may not be obtained. If the 100° C. kinematic viscosity is lower than 1 $mm^2/s$, the resulting lubricating oil composition would be poor in lubricity due to its insufficient oil film formation at lubricating sites and would be large in evaporation loss of the composition.

The above-exemplified lubricating base oil may be used alone or in combination or alternatively may be used in combination with one or more types of other base oils. When the base oil of the present invention is used in combination with the other base oils, the proportion of the base oil of the present invention in the mixed base oil is preferably 30 percent by mass or more, more preferably 50 percent by mass or more, more preferably 70 percent by mass or more.

No particular limitation is imposed on the other base oils used in combination with the base oil of the present invention. Examples of other mineral base oils include solvent-refined mineral oils, hydrocracked mineral oils, hydrorefined mineral oils, and solvent-dewaxed base oils, all of which have a 100° C. kinematic viscosity of higher than 10 $mm^2/s$ and 200 $mm^2/s$ or lower. Examples of other synthetic base oils include the above-described synthetic base oils which, however, have a 100° C. kinematic viscosity outside the range of 1 to 10 $mm^2/s$.

The lubricating oil composition of the present invention contains a 2,2,6,6-tetraalkylpiperidine derivative having a substituent at the 4-position as Component (A).

Examples of the substituent at the 4-position include carboxylate residue, alkoxy, alkylamino and amide groups. An alkyl group having 1 to 40 carbon atoms may be substituted at the N-position. Specific examples include compounds represented by the following formulas (a) to (f).

In the present invention, a carboxylate residue is particularly preferable. The carboxylic acid group is preferably one having an isoalkyl. The isoalkyl group is preferably an alkyl group having 6 to 30, preferably 10 or more, more preferably 16 or more carbon atoms and preferably 24 or fewer, more preferably 20 or fewer.

If the alkyl group has 5 or fewer carbon atoms, Component (A) would be too small in molecular weight and possibly evaporate at high temperatures. If the alkyl group has more than 30 carbon atoms, the resulting composition would be deteriorated in low temperature viscosity characteristics.

(a)

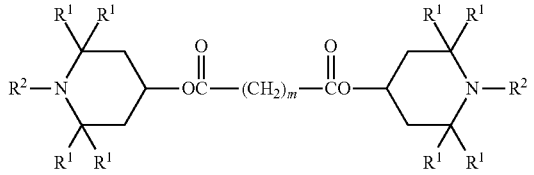

(b)

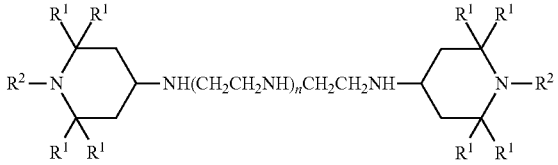

(c)

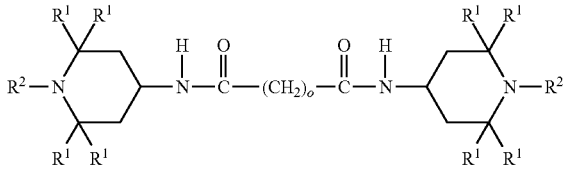

(d)

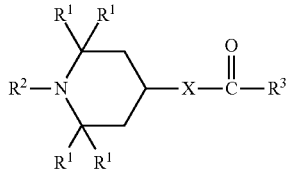

(e)

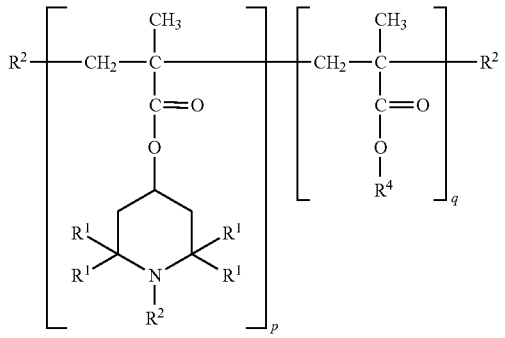

(f)

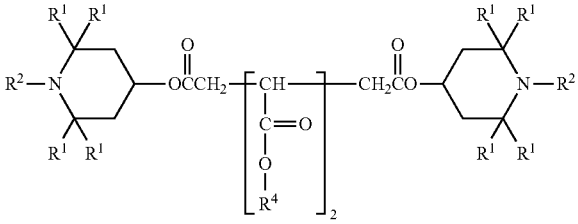

In the above formulas (a) to (f), $R^1$ is methyl, $R^2$ is hydrogen or an alkyl group having 1 to 4 carbon atoms, $R^3$ and $R^4$ are each an oil-soluble group having 4 or more carbon atoms, and m, n, o, p and q are each independently an integer of 1 to 30.

The lower limit content of Component (A) of the lubricating oil composition of the present invention is 0.005 percent by mass or more, preferably 0.01 percent by mass or more, particularly preferably 0.02 percent by mass or more as nitrogen on the basis of the total mass of the composition. Whilst, the upper limit content of Component (A) is 0.2 percent by mass or less, preferably 0.1 percent by mass or less as nitrogen on the basis of the total mass of the composition. If the content of Component (A) is less than 0.005 percent by mass, the resulting composition would be poor in high temperature detergency retainability. Whilst, if the content of Component (A) exceeds 0.2 percent by mass, the composition would be rather deteriorated in high temperature detergency due to formation of sludge caused by oxidation degradation.

The lubricating oil composition of the present invention contains an organic molybdenum compound and/or an organic tungsten compound as Component (B).

Examples of the organic molybdenum compound used in the present invention include various organic molybdenum compounds such as organic molybdenum compound containing sulfur and organic molybdenum compounds containing no sulfur as a constituent element.

Examples of the sulfur-containing organic molybdenum compound include molybdenum dithiophosphates, molybdenum dithiocarbamates, and the like.

Examples of molybdenum dithiophosphates include compounds represented by formula (4) below:

(4)

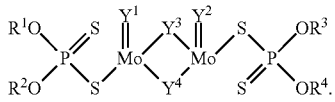

In formula (4) above, $R^1$, $R^2$, $R^3$ and $R^4$ may be the same or different from one another and an alkyl group having 2 to 30, preferably 5 to 18, more preferably 5 to 12 carbon atoms or an (alkyl)aryl group having 6 to 18, preferably 10 to 15 carbon atoms, and $Y^1$, $Y^2$, $Y^3$ and $Y^4$ are each independently sulfur or oxygen.

Examples of molybdenum dithiocarbamates include compounds represented by formula (5):

(5)

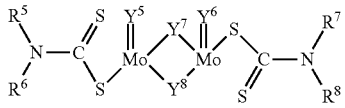

In formula (5), $R^5$, $R^6$, $R^7$ and $R^8$ may be the same or different from one another and are each a hydrocarbon group such as an alkyl group having 2 to 24, preferably 4 to 13 carbon atoms or an (alkyl)aryl group having 6 to 24, preferably 10 to 15 carbon atoms, and $Y^5$, $Y^6$, $Y^7$ and $Y^8$ are each independently sulfur or oxygen.

Examples of sulfur-containing organic molybdenum compounds other than those exemplified above include complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdic acid salts such as ammonium salts of these molybdic acids, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl(thio)xanthate, thiaziazole, mercaptothiadiazole, thiocarbonate, tetrahydrocarbylthiuramdisulfide, bis(di(thio)hydrocarbyldithiophosphonate)disulfide, organic (poly) sulfide, and sulfurized esters) or other organic compounds; complexes of sulfur-containing molybdenum compounds such as the above-mentioned molybdenum sulfides and sulfurized molybdenum acid and amine compounds, succinimides, organic acids, or alcohols, described below with respect to the organic molybdenum compounds containing no sulfur as a constituent; and sulfur-containing organic molybdenum compounds produced by reacting sulfur sources such as elemental sulfur, hydrogen sulfide, phosphorus pentasulfide, sulfur oxide, inorganic sulfides, hydrocarbyl (poly)sulfides, sulfurized olefins, sulfurized esters, sulfurized waxes, sulfurized carboxylic acids, sulfurized alkylphenols, thioacetamide, and thiourea, molybdenum compounds containing no sulfur as a constituent described below and sulfur-free organic compounds such as amine compounds, succinimides, organic acids and alcohols described below with respect to the molybdenum compounds containing no sulfur as a constituent. More specific examples of these sulfur-containing organic molybdenum compounds include those described in Japanese Patent Laid-Open Publication No. 56-10591 and U.S. Pat. No. 4,263,152 in detail.

Alternatively, the organic molybdenum compound may be an organic molybdenum compound containing no sulfur as a constituent.

Specific examples of the organic molybdenum compounds containing no sulfur as a constituent include molybdenum-amine complexes, molybdenum-succinimide complexes, molybdenum salts of organic acids, and molybdenum salts of alcohols. Preferred examples include molybdenum-amine complexes, molybdenum salts of organic acids, and molybdenum salts of alcohols.

Examples of the molybdenum compounds constituting the above-mentioned molybdenum-amine complexes include molybdenum compounds containing no sulfur such as molybdenum trioxide and hydrate thereof ($MoO_3.nH_2O$), molybdic acids ($H_2MoO_4$), alkali metal salts of molybdic acids ($M_2MoO_4$, wherein M indicates an alkali metal), ammonium molybdate ($(NH_4)_2MoO_4$ or $(NH_4)_6[Mo_7O_{24}].4H_2O$), $MOCl_5$, $MoOCl_4$, $MoO_2Cl_2$, $MoO_2Br_2$, and $Mo_2O_3Cl_6$. Among these, preferred are hexavalent molybdenum compounds in view of the yield of the molybdenum-amine complexes. More preferred among the hexavalent molybdenum compounds are molybdenum trioxide and hydrate thereof, molybdic acids, alkali metal salts of molybdic acids and ammonium molybdate in view of availability.

No particular limitation is imposed on the amine compound constituting the molybdenum-amine complex. Examples of nitrogen compounds include heterocyclic compounds such as those having an alkyl or alkenyl group having 8 to 20 carbon atoms bonded to monoamines, diamines and polyamines and imidazoline; alkyleneoxide adducts thereof; and mixtures thereof. Among these amine compounds, preferred examples include primary amines, secondary amines, and alkanolamines.

The carbon number of the amine compound constituting the molybdenum-amine complex is preferably 4 or greater, more preferably from 4 to 30, particularly preferably from 8 to 18. An amine compound having fewer than 4 carbon atoms would tend to be poor in solubility. The use of an amine compound having 30 or fewer carbon atoms can relatively increase the content of molybdenum in the molybdenum-amine complex, enabling the advantageous effects of the present invention to enhance even if the complex is added in a small amount.

Examples of the molybdenum-succinimide complex include complexes of the sulfur-free molybdenum compounds exemplified with respect to the above molybdenum-amine complex and succinimides having an alkyl or alkenyl group having 4 or more carbon atoms. Examples of the succinimides include succinimides having in their molecules at least one alkyl or alkenyl group having 40 to 400 carbon atoms and derivatives thereof as exemplified with respect to the ashless dispersant described below and those having an alkyl or alkenyl group having 4 to 39, preferably 8 to 18 carbon atoms. A succinimide having fewer than 4 carbon atoms would tend to be poor in solubility. A succinimide having an alkyl or alkenyl group having more than 30 but 400 or fewer carbon atoms may be used. However, the use of a succinimide having 30 or fewer carbon atoms can relatively increase the content of molybdenum in the molybdenum-amine complex, enabling the advantageous effects of the present invention to enhance even if the complex is added in a small amount.

Examples of the molybdenum salts of organic acids include salts of molybdenum bases such as molybdenum oxide or hydroxide exemplified with respect to the molybdenum-amine complex, molybdenum carbonate and molybdenum chlorides and organic acids. The organic acids are preferably phosphorus-containing acids or carboxylic acids.

The carboxylic acid constituting the molybdenum salt of a carboxylic acid may be a monobasic acid or a polybasic acid.

Examples of the monobasic acid include fatty acids having usually 2 to 30, preferably 4 to 24 carbon atoms, which may be straight-chain or branched and saturated or unsaturated.

Other than the above-exemplified fatty acids, the monobasic acid may be a monocyclic or polycyclic carboxylic acid (may have a hydroxyl group). The carbon number of the monocyclic or polycyclic carboxylic acid is preferably from 4 to 30, more preferably from 7 to 30. Examples of the monocyclic or polycyclic carboxylic acid include aromatic or cycloalkyl carboxylic acids having 0 to 3, preferably 1 or 2 straight-chain or branched alkyl groups having 1 to 30, preferably 1 to 20 carbon atoms. More specific examples include (alkyl)benzene carboxylic acids, (alkyl)naphthalene carboxylic acids, and (alkyl)cycloalkyl carboxylic acids. Preferred examples of the monocyclic or polycyclic carboxylic acid include benzoic acid, salicylic acid, alkylbenzoic acid, alkylsalicylic acid, and cyclohexane carboxylic acid.

Examples of the polybasic acid include dibasic acids, tribasic acid, and tetrabasic acids. The polybasic acid may be a chain or cyclic polybasic acid. The chain polybasic acid may be straight-chain or branched and saturated or unsaturated. The chain polybasic acid is preferably a chain dibasic acid having 2 to 16 carbon atoms.

Examples of the molybdenum salts of alcohols include salts of the sulfur-free molybdenum compounds exemplified with respect to the molybdenum-amine complexes and alcohols. Examples of the alcohols include monohydric alcohols, polyhydric alcohols, partial esters or partial etherified compounds of polyhydric alcohols, and nitrogen compounds having a hydroxyl group (alkanolamines). Molybdic acid is a strong acid and thus forms an ester by reacting with an alcohol. Such an ester is also included within the molybdenum salts of alcohols defined by the present invention.

The monohydric alcohols may be those having usually 1 to 24, preferably 1 to 12, more preferably 1 to 8 carbon atoms. Such alcohols may be straight-chain or branched and saturated or unsaturated The polyhydric alcohols may be those of usually dihydric to decahydric, preferably dihydric to hexahydric.

Examples of the partial esters of polyhydric alcohols include compounds produced by hydrocarbyl-esterifying a part of the hydroxyl groups of any of the above-exemplified polyhydric alcohols. Among such compounds, preferred examples include glycerin monooleate, glycerin dioleate, sorbitan monooleate, sorbitan dioleate, pentaerythritol monooleate, polyethylene glycol monooleate, and polyglycerin monooleate.

Examples of the partial ethers of polyhydric alcohols include compounds produced by hydrocarbyl-esterifying a part of the hydroxyl groups of any of the above-exemplified polyhydric alcohols and compounds having an ether bond formed by condensation of the polyhydric alcohols with one another (sorbitan condensate or the like). Among these compounds, preferred examples include 3-octadecyloxy-1,2-propanediol, 3-octadecenyloxy-1,2-propanediol, and polyethylene glycol alkylethers.

Examples of the nitrogen compounds having a hydroxyl group include the alkanolamines exemplified with respect to the above-described molybdenum-amine complex and alkanolamides (diethanolamide) wherein the amide group of the alkanolamines is amidized. Among these compounds, preferred examples include stearyl diethanolamine, polyethylene glycol stearylamine, polyethylene glycol dioleylamine, hydroxyethyl laurylamine, and oleic acid diethanolamide.

Preferred examples of the sulfur-containing organic molybdenum compounds used in the present invention include molybdenum dithiocarbamates and molybdenum dithiophosphates because they are excellent in friction reducing effect. It is also desirable to use reaction products of the above-described sulfur sources, molybdenum compounds containing no sulfur as a constituent, and sulfur-free organic compounds (succinimide) or the above-described organic molybdenum compounds containing no sulfur as a constituent because they are excellent in anti-oxidation effect and can reduce deposits on the top ring grooves of an diesel engine.

No particular limitation is imposed on the content of Component (B), i.e., the organic molybdenum compound of the composition of the present invention, which is, however, preferably 0.001 percent by mass or more, more preferably 0.005 percent by mass or more, more preferably 0.01 percent by mass or more and preferably 0.2 percent by mass or less, more preferably 0.1 percent by mass or less, more preferably 0.05 percent by mass or less, particularly preferably 0.02 percent by mass or less, as molybdenum on the total composition mass basis. If the content is less than 0.001 percent by mass, the resulting composition would be insufficient in thermal/oxidation stability and tend to fail to maintain excellent detergency for a long period of time. Whilst, if the content exceeds 0.2 percent by mass, the resulting composition would fail to exhibit its advantageous effects as balanced with the content and poor in storage stability.

Examples of the organic tungsten compound used in the lubricating oil composition of the present invention include organic tungsten compounds containing no sulfur as a constitution element and sulfur-containing tungsten compounds such as tungsten dithiocarbamates. In particularly, the use of a sulfur-containing organic tungsten compound can obtain a more excellent effects to prevent acid value increase and more excellent base number retainability.

Specific examples of the organic tungsten compound containing no sulfur as a constitution element include tungsten-amine complexes, tungsten-succinimide complexes, tungstates of organic acids, tungstates of alcohol, among which tungsten-amine complexes, tungstates of organic acids and tungstates of alcohol are preferable.

Alternatively, the organic tungsten compound may be any of sulfur-containing organic tungsten compounds such as tungsten-amine complexes, tungsten-succinimide complexes, tungstates of organic acids and tungstates of alcohol, produced by reacting a sulfur source such as carbon disulfide or an elemental sulfur with any of the above-described tungsten compounds containing no sulfur as a constituent element and amine, succinimide, an organic acid or an alcohol.

Alternatively, the organic tungsten compound may be a sulfur-containing organic tungsten compound produced by reacting a sulfur-containing organic tungsten compound the whole or part or whole of which is sulfurized (for example, sulfur-containing tungsten compounds such as sulfurized oxytungsten compound, sulfurized tungsten compound and the like) with amine, succinimide, an organic acid or an alcohol.

Further alternatively, the organic tungsten compound may be a tungstate of a sulfur-containing organic acid produced by reacting any of the above-described tungsten compounds or sulfur-containing tungsten compounds with a sulfur-containing organic acid compound such as dithiocarbamic acid, dithiophosphate, sulfonic acid, xanthogenic acid or a derivative thereof in place of the above organic acid if necessary adding a sulfur source such as carbon disulfide, an elemental sulfur or the like.

The tungsten dithiocarbamate (tungsten dithiocarbamate compound) can have various structures depending on the valence or constituent element of the tungsten compounds but examples includes compounds represented by formula (6) below, more specifically for examples tungsten dithiocarbamate, oxytungsten dithiocarbamate, sulfurized oxytungsten dithiocarbamate, and sulfurized tungsten dithiocarbamates:

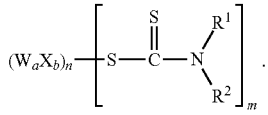

(6)

In formula (6) above, $R^1$ and $R^2$ are each independently a hydrocarbon group having 1 to 30 carbon atoms, X is oxygen and/or sulfur, a is an integer of 1 or 2, b is an integer of 0 to 4, m is an integer of 1 to 6 and n is an integer of 1 to 6.

The tungsten dithiophosphate (tungsten dithiophosphate compound) can have various structure depending on the valence or constituent element of the tungsten compound, but examples include tungsten dithiophosphate compounds represented by formula (7) below, more specifically for example tungsten dithiophosphate, oxytungsten dithiophos phate, sulfurized oxytungsten dithiophosphate, and sulfurized tungsten dithiophosphates:

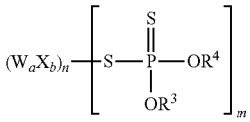

(7)

In formula (7), $R^3$ and $R^4$ are each independently a hydrocarbon group having 1 to 30 carbon atoms, X is oxygen and/or sulfur, a is an integer of 1 or 2, b is an integer of 0 to 4, m is an integer of 1 to 6 and n is an integer of 1 to 6.

The tungsten sulfonate may be a tungsten sulfonate having a hydrocarbon group having 1 to 30 carbon atoms, such as tungsten alkylsulfonates, tungsten alkylbenzene sulfonates, and tungsten alkylnaphthalene sulfonates.

The tungsten xanthate may be a tungsten xanthate having a hydrocarbon group having 1 to 30 carbon atoms.

The organic tungsten compound may be a compound that is any of the above-described tungsten dithiocarbamate, tungsten xanthate or tungsten dithiophosphate, wherein all or part of the sulfur atoms in their molecules are replaced with oxygen.

Alternatively, the organic tungsten compound may be a polytungstate that is a hydrated polymer compound. The polytungstate may be used as a colloidal suspension comprising a dispersion phase containing polytungstate and an oil phase containing a dispersing auxiliary agent and a diluent oil. Examples of the dispersing auxiliary agent include basic nitrogen compounds selected from the group consisting of polyalkylene succinic anhydrides, non-boron-containing derivatives of polyalkylene succinic anhydrides, succinimide, carboxylic amide, hydrocarbon monoamine, hydrocarbon polyamine, Mannich base, phosphonamide, thiophosphonamide, phosphoramide and mixtures thereof. No particular limitation is imposed on the diluent oil if it can form a stable emulsified liquid having a water phase containing polytungstate and an oil phase containing a dispersing auxiliary agent and a diluent oil. However, a hydrocarbon-based lubricating base oil is preferably used.

No particular limitation is imposed on the method for preparing the above-mentioned colloidal suspension. For examples, an intended colloidal suspension can be produced by mixing and stirring a monomer compound ($WO_2$, $WO_3$ or the like) containing tungsten, an aqueous solution containing acid in an effective amount to polymerize at least partially the monomer compound, a dispersant and a diluent oil to form a micro emulsion and then heating the micro emulsion to remove the water. The aqueous solution used in the mixing and stirring step preferably further contains a hydroxide such as an alkali metal hydroxide, an alkaline earth hydroxide, ammonium hydroxide or thallium hydroxide.

The content of Component (B), i.e., the organic tungsten compound of the lubricating oil composition of the present invention is preferably 0.001 percent by mass or more, more preferably 0.01 percent by mass or more, more preferably 0.04 percent by mass or more, particularly preferably 0.1 percent by mass or more and preferably 0.2 percent by mass or less, more preferably 0.1 percent by mass or less, more preferably 0.04 percent by mass or less, as tungsten on the total composition mass basis. If the content of the organic tungsten compound is less than 0.001 percent by mass as tungsten, anti-oxidation properties, base number retainability, high temperature detergency and resistance characteristics to NOx obtained by using the organic tungsten compound in combination with an ashless anti-oxidant would be insufficient. If the content exceeds 0.2 percent by mass, an effect to enhance these properties as balanced with the increased content would not be obtained.

The lubricating oil composition of the present invention preferably comprises a hindered phenol-type anti-oxidant and/or an aromatic amine-type anti-oxidant as Component (C). Inclusion of Component (C) is extremely effective in enhancing oxidation stability with the presence of (A) a 2,2,6,6-tetraalkylpiperidine derivative and (B) an organic molybdenum compound.

Specific examples of the hindered phenol-type anti-oxidant include 4,4'-methylene bis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], octyl-3-(3,5-di-tert-butyl-4-hydroxyphenyl) propionate, tridecyl-3-(3,5-di-tert-butyl-4-hydroxyphenyl) propionate, pentaerythrityl-tetraquis[3-(3,5-di-tert-butyl-4-hydroxyphenyl)propionate], octadecyl-3-(3,5-di-tert-butyl-4-hydroxyphenyl)propionate, and mixtures thereof. Among these compounds, phenol-based compounds having a molecular weight of 240 or greater are preferably used because they are high in decomposition temperature and can exhibit an anti-oxidation effect under higher temperature conditions.

The content of the hindered phenol-type anti-oxidant if contained is preferably 0.1 percent by mass or more, more preferably 0.3 percent by mass or more, particularly preferably 0.4 percent by mass or more on the basis of the total mass of the composition. Whilst, the upper limit content is preferably 3 percent by mass or less, more preferably 2 percent by mass or less, particularly preferably 1.0 percent by mass or less. With the content of 0.1 percent by mass or more, the composition of the present invention is likely to maintain excellent detergency for a long period of time. The content of more than 3 percent by mass is not preferable because the composition would be degraded in storage stability.

Examples of the aromatic amine-type anti-oxidant include phenyl-α-naphtylamines, alkylphenyl-α-naphtylamines, dialkyldiphenylamines, N,N'-diphenyl-p-phenylene diamine, and mixtures thereof. Examples of the alkyl group include straight-chain or branched alkyl groups having 1 to 20 carbon atoms.

The content of the aromatic amine-type anti-oxidant if contained is preferably 0.1 percent by mass or more, more preferably 0.3 percent by mass or more, particularly preferably 0.4 percent by mass or more on the basis of the total mass of the composition. Whilst, the upper limit content is preferably 5 percent by mass or less, preferably 2.5 percent by mass or less, particularly preferably 2.0 percent by mass or less. With the content of 0.1 percent by mass or more, the composition of the present invention is likely to maintain excellent detergency for a long period of time. The content of more than 5 percent by mass is not preferable because the resulting composition would be poor in storage stability.

Component (C) of the lubricating oil composition of the present invention is more preferably a hindered phenol-type anti-oxidant.

The lubricating oil composition of the present invention preferably contains at least one type of compound (phosphorus-containing antiwear agent) selected from the group consisting of phosphorus compounds represented by formula (1) and metal salts thereof as Component (D).

(1)

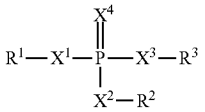

In formula (1), $X^1$, $X^2$, $X^3$ and $X^4$ are each independently oxygen or sulfur and at least two of them are oxygen, and $R^1$, $R^2$ and $R^3$ are each independently hydrogen or a hydrocarbon group having 1 to 30 carbon atoms.

Examples of the hydrocarbon groups having 1 to 30 carbon atoms for $R^1$ to $R^3$ include alkyl, cycloalkyl, alkenyl, alkyl-substituted cycloalkyl, aryl, alkyl-substituted aryl, and arylalkyl groups.

The hydrocarbon groups having 1 to 30 carbon atoms for $R^1$ to $R^3$ are preferably alkyl groups having 1 to 30 carbon atoms or aryl groups having 6 to 24 carbon atoms, more preferably alkyl groups having preferably 3 to 18, more preferably 4 to 12 carbon atoms.

Examples of the phosphorus compounds represented by formula (1) include the following phosphorus compounds:

phosphorus acid; monothiophosphorus acids; phosphorus acid monoesters and monothiophosphorus acid monoesters having any one of the above-exemplified hydrocarbon groups having 1 to 30 carbon atoms; phosphorus acid diesters and monothiophosphorus acid diesters having any two of the above-exemplified hydrocarbon groups having 1 to 30 carbon atoms; phosphorus acid triesters and monothiophosphorus acid triesters having any three of the above-exemplified hydrocarbon groups having 1 to 30 carbon atoms; and mixtures thereof.

Examples of the salts of the phosphorus compounds represented by formula (1) include salts produced by allowing a metal base such as a metal oxide, a metal hydroxide, a metal carbonate or a metal chloride to react with a phosphorus compound to neutralize the whole or part of the remaining acid hydrogen.

Examples of the metals of the above metal base include alkaline earth metals such as calcium, magnesium and barium and heavy metals such as zinc, copper, iron, lead, nickel, silver, manganese and tungsten. Among these metals, preferred are alkaline earth metals such as calcium and magnesium, and particularly preferred is zinc.

The salts of the phosphorus compounds represented by formula (1) are particularly preferably zinc alkyldithiophosphates, preferably secondary zinc alkyldithiophosphates. The alkyl groups are preferably those having 3 to 6 carbon atoms.

Among these Components (D), preferred are salts of phosphorus acid diesters having two alkyl or aryl groups having 3 to 18 carbon atoms and zinc or calcium; phosphorus acid triesters having three alkyl or aryl groups having 3 to 18 carbon atoms, preferably three alkyl groups having 6 to 12 carbon atoms; salts of phosphoric acid monoesters having one alkyl or aryl group having 3 to 18 carbon atoms and zinc or calcium; salts of phosphoric acid diesters having two alkyl or aryl groups having 3 to 18 carbon atoms and zinc or calcium; and phosphoric acid triesters having three alkyl or aryl groups having 3 to 18 carbon atoms, preferably three alkyl groups having 6 to 12 carbon atoms.

One or more types of compounds among Components (D) may be arbitrarily blended.

In the present invention, preferred are metal salts of compounds represented by formula (1), and more preferred are those of compounds represented by formula (1) wherein all Xs are oxygen. The metal salts of the compounds are preferably metal salts excluding those of alkali metals.

The metal salts of the compounds vary in structure depending on the valence of the metals or the number of OH group of the phosphorus compounds and are preferably those having a structure represented by formula (2) or (3). Particularly preferred are salts of zinc.

(2)

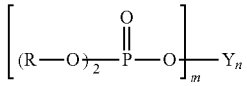

(3)

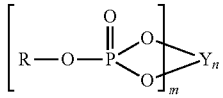

In formula (2) and (3), Rs are each an alkyl or aryl group having 1 to 30 carbon atoms and may be the same or different from each other, Y is metal excluding alkali metal, and m and n are each an integer of 1 to 4.

The content of Component (D) of the lubricating oil composition of the present invention is 0.005 percent by mass or more, preferably 0.01 percent by mass or more, particularly preferably 0.02 percent by mass or more as phosphorus on the total composition mass basis. Whilst, the content is 0.5 percent by mass or less, preferably 0.2 percent by mass or less, more preferably 0.1 percent by mass or less, more preferably 0.08 percent by mass or less. If the content of Component (D) is less than 0.005 percent by mass as phosphorus, the resulting composition is less effective in anti-wear properties. If the content of Component (D) is more than 0.5 percent by mass, phosphorus may adversely affects an exhaust-gas after-treatment system if the composition is used in an internal combustion engine. When the content of Component (D) is 0.08 percent by mass or less, particularly 0.05 percent by mass or less as phosphorus, the resulting composition can be significantly reduced in influence to an exhaust-gas after-treatment.

The lubricating oil composition of the present invention preferably contains a metallic detergent having a metal ratio of 3 or less as Component (E).

The term "metal ratio" used herein is represented by "valence of metal element×metal element content (mole %)/soap group (content (mole %)). That is, the metal ratio indicates the alkali metal or alkaline earth metal content with respect to the alkyl salicylic acid group or alkyl sulfonic acid group content in the alkali metal or alkaline earth metal detergent.

Examples of the metallic detergent include alkali metal sulfonates or alkaline earth metal sulfonates, alkali metal phenates or alkaline earth metal phenates, alkali metal salicylates or alkaline earth metal salicylates, alkali metal carboxylates or alkaline earth metal carboxylates. In the present invention, one or more types of alkali metal or alkaline earth metal detergent selected from the group consisting of these compounds may be used, and alkaline earth metal detergents is preferably used.

Examples of the alkali metal or alkaline earth metal sulfonate include alkali metal or alkaline earth metal salts, particularly preferably magnesium and/or calcium salts, of alkyl aromatic sulfonic acids, produced by sulfonating an alkyl aromatic compound having a molecular weight of 300 to 1,500, preferably 400, to 700. Calcium salts are preferably used.

Specific examples of the alkyl aromatic sulfonic acids include petroleum sulfonic acids and synthetic sulfonic acids.

Examples of the alkali metal or alkaline earth metal phenates include alkali metal and alkaline earth metal salts, particularly magnesium salts and calcium salts of alkylphenols, alkylphenolsulfides or the Mannich reaction products of alkylphenols.

Examples of the alkali metal or alkaline earth metal salicylates include alkali metal or alkaline earth metal salts, preferably magnesium and calcium salts of an alkylsalicylic acid. Specific examples include compounds represented by formula (8):

(8)

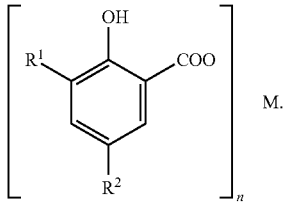

In formula (8), $R^1$ and $R^2$ may be the same or different from each other and are each independently hydrogen or a hydrocarbon group having 1 to 40 carbon atoms, and the hydrocarbon group may contain oxygen or nitrogen. However, both $R^1$ and $R^2$ are not hydrogen. M is an alkali metal or alkaline earth metal, preferably calcium or magnesium, and n is an integer of 1 or 2 depending on the valence of the metal.

Although metallic detergents are usually commercially available as diluted with a light lubricating base oil, it is preferable to use a metallic detergent whose metal content is from 1.0 to 20 percent by mass, preferably from 2.0 to 16 percent by mass.

Although the base number of the alkaline earth metal detergent is arbitrary, it is usually from 0 to 500 mgKOH/g, preferably 60 to 230 mgKOH/g, more preferably 60 to 190 mgKOH/g.

The term "total base number" used herein denotes one measured by the perchloric acid potentiometric titration method in accordance with section 7 of JIS K2501 "Petroleum products and lubricants-Determination of neutralization number".

The metal ratio of Component (E), i.e., the metallic detergent used in the present invention is preferably 3 or less. The metal ratio is preferably 2.6 or less, more preferably 2 or less, particularly preferably 1.5 or less. In the present invention, preferable metallic detergents with a metal ratio of 3 or less are various above-described metallic detergents. However, preferably, alkaline earth metal sulfonates and/or alkaline earth metal phenates, particularly preferably alkaline earth metal sulfonates are used because they can easily inhibit the deterioration of anti-wear properties or the increase of acid number. The use of Component (E) with the component structure as described above can enhance effects to improve base number retention properties, high-temperature detergency and low friction characteristics.

In addition to Component (E), the composition of the present invention may further contain a metallic detergent with a metal ratio of greater than 3, preferably 5 or greater, more preferably 8 or greater and preferably 40 or less, more preferably 20 or less, more preferably 15 or less. Preferable examples of such metallic detergent with a metal ratio of greater than 3 include the above-described various metallic detergents. However, preferably alkaline earth metal sulfonates and/or alkaline earth metal phenates, particularly preferably alkaline earth metal sulfonates are used because they can easily inhibit the deterioration of anti-wear properties or the increase of acid number. In particular, when an alkaline earth metal salicylate is used as Component (E), it is desirous to use an alkaline earth metal sulfonate and/or an alkaline earth metal phenate as the metallic detergent with a metal ratio of greater than 3 because they are excellent in storage stability.

The blend ratio of the metallic detergent with a metal ratio of greater than 3 is the metallic detergent with a metal ratio of greater than 3: the metallic detergent with a metal ratio of 3 or less within the range of preferably 10 to 90 percent by mass: 90 to 10 percent by mass, more preferably 40 to 85 percent by mass: 60 to 15 percent by mass, more preferably 50 to 80 percent by mass: 50 to 20 percent by mass, in terms of the total metal content originating from the metallic detergents.

The total content of the metallic detergents in the composition of the present invention is preferably from 0.01 to 0.2 percent by mass, more preferably from 0.05 to 0.16 percent by mass, more preferably from 0.08 to 0.12 percent by mass in terms of alkali metal or alkaline earth metal element, on the basis of the total mass of the composition. If the content of the metallic detergent is less than 0.01 percent by mass, the resulting composition would fail to exhibit excellent base number retention properties and high-temperature detergency as achieved with the composition of the present invention. The content of the metallic detergent of more than 0.2 percent by mass is not also preferable because the sulfated ash content of the resulting composition cannot be within the range intended by the invention.

The lubricating oil composition of the present invention preferably contains an ashless dispersant as Component (F).

Examples of the ashless dispersant include nitrogen-containing compounds having in per molecule at least one straight-chain or branched alkyl or alkenyl group having 40 to 400 and derivatives thereof and modified products of alkenylsuccinicimides. Any one or more type selected from these ashless dispersants may be blended in the lubricating oil composition of the present invention.

The carbon number of the alkyl or alkenyl group of the ashless dispersant is preferably 40 to 400, more preferably 60 to 350. If the carbon number of the alkyl or alkenyl group is fewer than 40, the ashless dispersant would tend to be degraded in solubility in the lubricating base oil. Whereas, if the carbon number of the alkyl or alkenyl group is more than 400, the resulting lubricating oil composition would be degraded in low-temperature fluidity. The alkyl or alkenyl group may be straight-chain or branched but is preferably a branched alkyl or alkenyl group derived from oligomers of olefins such as propylene, 1-butene or isobutylene or a cooligomer of ethylene and propylene.

The succinimide includes a mono-type succinimide wherein a succinic anhydride is added to one end of a polyamine and a bis-type succinimide wherein a succinic anhydride is added to both ends of a polyamine.

The lubricating oil composition of the present invention may contain either one or both of the mono-type and bis-type succinimides.

The ashless dispersant may be a benzylamine. Preferred examples of the benzylamine include compounds represented by formula (9):

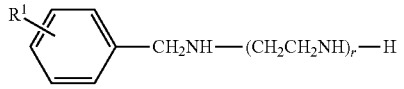

(9)

In formula (9), $R^1$ is an alkyl or alkenyl group having 40 to 400, preferably 60 to 350 and r is an integer of 1 to 5, preferably 2 to 4.

No particular limitation is imposed on the method for producing the benzylamines. They may be produced by reacting a polyolefin such as a propylene oligomer, polybutene, or ethylene-α-olefin copolymer with a phenol so as to produce an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of the aforementioned polyamine include compounds represented by formula (10).

$$R^2—NH—(CH_2CH_2NH)_s—H \quad (10)$$

In formula (10), $R^2$ is an alkyl or alkenyl group having 40 to 400, preferably 60 to 350 carbon atoms and s is an integer of 1 to 5, preferably 2 to 4.

Specific examples of the other derivative include an organic acid-modified compound produced by allowing any of the above-described nitrogen-containing compounds to react with a monocarboxylic acid (fatty acids or the like) having 1 to 30 carbon atoms, a polycarboxylic acid having 2 to 30 carbon atoms, such as oxalic acid, phthalic acid, trimellitic acid, and pyromellitic acid or an oxygen-containing compound such as alcohol, aldehyde, ketone, alkylphenol, cyclic carbonate (for example, ethylene carbonate), hydroxy(poly)alkylene carbonate, so as to neutralize or amidize the whole or part of the remaining amino and/or imino groups; and a sulfur modified-compound produced by allowing any of the above-described nitrogen-containing compounds to react with a sulfur compound. Alternatively, a boron-modified compound may also be used.

When the lubricating oil composition of the present invention contains the ashless dispersant, the content thereof is preferably from 0.01 to 20 percent by mass, more preferably from 0.1 to 10 percent by mass based on the total mass of the lubricating oil composition. If the ashless dispersant content is less than 0.01 percent by mass, the resulting composition would be insufficient in friction-reducing effect. Whilst, if the content exceeds 20 percent by mass, the resulting lubricating oil composition would be extremely degraded in low temperature fluidity.

If necessary, the lubricating oil composition of the present invention may be blended with various additives such as viscosity index improvers, antiwear agents (extreme pressure additives), corrosion inhibitors, rust inhibitors, demulsifiers, metal deactivators, and anti-foaming agents, alone or in combination in order to further enhance the properties of the composition or impart the composition with properties required for a lubricating oil.

The viscosity index improver is specifically a non-dispersant type or dispersant type ester group-containing viscosity index improver. Examples of such a viscosity index improver include non-dispersant type or dispersant type poly(meth)acrylate viscosity index improvers, non-dispersant type or dispersant type olefin-(meth)acrylate copolymer viscosity index improvers, styrene-maleic anhydride ester copolymer viscosity index improvers, and mixtures thereof. Preferred are non-dispersant type or dispersant type poly (meth)acrylate viscosity index improvers. Particularly preferred are non-dispersant type or dispersant type poly(meth) acrylate viscosity index improvers.

Other examples of the viscosity index improver include non-dispersant type or dispersant type ethylene-α-olefin copolymers or hydrogenated compounds thereof, polyisobutylene and hydrogenated compounds thereof, styrene-diene hydrogenated copolymers, and polyalkylstyrenes.

The weight-average molecular weight (MW) of the viscosity index improver used in the present invention is preferably 600,000 or less, more preferably 500,000 or less, more preferably 450,000 or less, more preferably 100,000 or less. Whilst, the Mw is preferably 100,000 or greater, more preferably 20,000 or greater, more preferably 250,000 or greater. If the viscosity index improver has a weight average molecular weight of less than 100,000, it would be less effective in viscosity index enhancement when it is dissolved in a lubricating base oil and the resulting composition would not only be poor in fuel saving properties and low temperature viscosity characteristics but also be high in production cost. If the viscosity index improver has a weight-average molecular weight of greater than 600,000, it would exert the viscosity increasing effect too much and thus the resulting composition would not only be poor in fuel saving properties and low temperature viscosity characteristics but also be degraded in shear stability, solubility in a lubricating base oil and storage stability.

The viscosity index improver used in the present invention has a PSSI (permanent shear stability index) of necessarily 70 or less, more preferably 60 or less. If the PSSI exceeds 70, the resulting composition would be degraded in shear stability and thus needed to be enhanced in initial kinematic viscosity, possibly resulting in degraded fuel saving properties. If the PSSI is less than 10, the viscosity index improver would be less effective in viscosity index enhancement when it is dissolved in a lubricating base oil and thus the resulting composition would not only be poor fuel saving properties and low temperature viscosity characteristics but also increased in production cost. The PSSI is, therefore, preferably 10 or greater.

The antiwear agent (or extreme pressure additive) may be any antiwear agents or extreme pressure additives that are used for lubricating oil. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithlocaramates, disulfides, polysulfides, sulfurized olefins and sulfurized fats and oils. Among these antiwear agents, preferred are sulfuric extreme pressure additives, and particularly preferred are sulfurized fats and oils.

Examples of the corrosion inhibitor include benzotriazole-, tolytriazole-, thiadiazole-, and imidazole-types compounds.

Examples of the rust inhibitor include petroleum sulfonates, alkylbenzene sulfonates, dinonylnaphthalene sulfonates, alkenyl succinic acid esters, and polyhydric alcohol esters.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil with a 25° C. kinematic viscosity of 1000 to 100,000 $mm^2/s$, alkenylsuccinic acid derivatives, esters of polyhydroxy aliphatic alcohols and long-chain fatty acids, aromatic amine salts of methylsalicylate and o-hydroxybenzyl alcohol.

When these additives are contained in the lubricating oil composition, the content of the anti-foaming agent is selected from the range of 0.0005 to 1 percent by mass of and the content of the other additives is usually selected from the range of 0.01 to 10 percent by mass.

Among the lubricating oil compositions of the present invention, a specific lubricating oil composition is suitably used for a method for lubricating a copper- and/or lead-containing sliding material.

Specifically, a lubricating oil composition comprising a lubricating base oil, (A) a 2,2,6,6-tetraalkylpiperidine derivative, (B) an organic molybdenum compound in an amount of 30 to 300 ppm by mass as molybdenum and (C) a hindered phenol-type anti-oxidant and/or an aromatic amine-type anti-oxidant is suitably used for a method for lubricating a copper- and/or lead-containing sliding material by being contacted therewith.

The content of Component (B), i.e., the organic molybdenum compound of the lubricating oil composition used in a method for lubricating a copper- and/or lead-containing sliding materials is from 30 to 300 ppm by mass, preferably 50 ppm by mass or more, more preferably 100 ppm by mass or more, more preferably 120 ppm by mass or more and preferably 200 ppm by mass or less, more preferably 250 ppm by mass or less, more preferably 300 ppm by mass or less, particularly preferably 200 ppm by mass or less, as molybdenum metal on the total composition mass basis. If the content is less than 30 ppm by mass, the composition would be lack in effects to prevent elution of copper and lead. Whilst, if the content exceeds 300 ppm by mass, the composition would fail to obtain effects as balanced with the content and tend to be degraded in at low temperatures.

As described above, iron-based materials and aluminum-based materials are mainly used as sliding materials, but aluminum-, tin-, copper- and/or lead-containing materials are sometimes used for the main bearing or con rod bearing of an internal combustion engine. The copper-lead bearing is excellent in strength and fitness, and in particular, lead-containing materials have excellent features that they are less in fatigue phenomenon but also have a drawback that they are large in corrosion wear. Therefore, it is very effective to prevent such corrosion.

The present invention can prevent elution of the copper and lead by contacting the above-described lubricating oil composition with a copper- and/or lead-containing sliding materials and in particular is more effective for bearings containing copper and lead and further effective for bearings containing lead on their surfaces. In particular, the method of the present invention is excellent in preventing the bearings of an internal combustion engine from wearing caused by corrosion and thus will be a measure for an internal combustion engine undergoing corrosion wear.

EXAMPLES

The present invention will be described in more detail below with reference to the following Examples and Comparative Examples but are not limited thereto.

Examples 1 to 18 and Comparative Examples 1 to 7

Lubricating oil compositions according to the present invention (Examples 1 to 18) and those for comparison (Comparative Examples 1 to 7) were prepared. A NOx blowing test was carried out for each of the compositions. The test was carried out under conditions where oxygen supplied at a flow rate of 115 ml/min was mixed with NO diluted with nitrogen (NO concentration: 800 ppm) supplied at a flow rate of 20 ml/min and then introduced in 150 g of a sample at an oil temperature of 140° C. The test time was set forth together with the results in Table 1.

As apparent from the results set forth in Table 1, the lubricating oil compositions of Examples 1 to 18 are significantly superior in NOx resistance to the compositions of Comparative Examples 1 to 7 not containing Component (A) or (B).

The chemical structural formulas of HALS 1, HALS 2 and HALS 3 in Table 1 are shown below.

HALS1

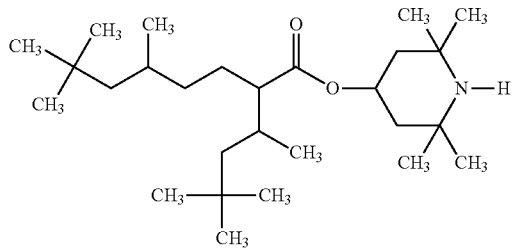

HALS2

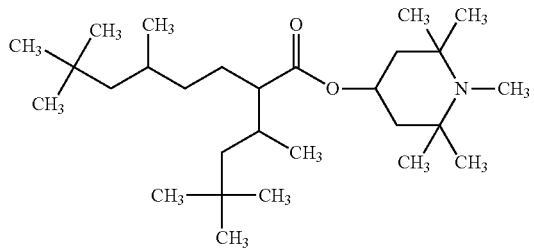

HALS3

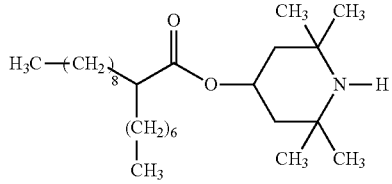

TABLE 1

| | | Example 1 | Example 2 | Example 3 | Example 4 | Example 5 | Example 6 | Example 7 | Example 8 |
|---|---|---|---|---|---|---|---|---|---|
| Lubricating base oil 1) | | balance | balance | balance | balance | balance | balance | balance | balance |
| (A)HALS1 2) | mass % | 0.5 | 0.5 | 0.5 | 0.5 | 0.5 | 0.5 | — | — |
| (A)HALS2 3) | mass % | — | — | — | — | — | — | 0.5 | — |
| (A)HALS3 4) | mass % | — | — | — | — | — | — | — | 0.5 |
| (B) molybdenum alkylphosphate 5) | mass % | 0.155 | 0.155 | 0.155 | — | — | 0.155 | 0.155 | 0.155 |
| (B) molybdenum alkyldithiophosphate 6) | mass % | — | — | — | 0.165 | — | — | — | — |
| (B) molybdenum dialkylamine salt 7) | mass % | — | — | — | — | 0.15 | — | — | — |
| Amount as molybdenum | mass % | 0.015 | 0.015 | 0.015 | 0.015 | 0.015 | 0.015 | 0.015 | 0.015 |
| (C) hindered phenol compound 1 8) | mass % | — | — | 0.5 | 0.5 | 0.5 | — | 0.5 | 0.5 |
| (C) hindered phenol compound 2 9) | mass % | — | — | — | — | — | 0.5 | — | — |
| (D) zinc alkylphosphate 10) | mass % | 0.7 | — | 0.7 | 0.7 | 0.7 | 0.7 | 0.7 | 0.7 |
| Amount as phosphorus | mass % | 0.07 | — | 0.07 | 0.07 | 0.07 | 0.07 | 0.07 | 0.07 |
| zinc alkyldithiophosphate 11) | mass % | — | 1 | — | — | — | — | — | — |
| Amount as phosphorus | mass % | — | 0.07 | — | — | — | — | — | — |
| alkyldiphenylamine 12) | mass % | | | | | | | | |
| metallic detergent 13) | mass % | 3.3 | 3.3 | 3.3 | 3.3 | 3.3 | 3.3 | 3.3 | 3.3 |
| ashless dispersant 14) | mass % | 5 | 5 | 5 | 5 | 5 | 5 | 5 | 5 |
| viscosity index improver 15) | mass % | 5 | 5 | 5 | 5 | 5 | 5 | 5 | 5 |
| Properties of composition | | | | | | | | | |
| phosphorus content | mass % | 0.075 | 0.075 | 0.075 | 0.075 | 0.07 | 0.075 | 0.075 | 0.075 |
| Ca content | mass % | 0.2 | 0.2 | 0.2 | 0.2 | 0.2 | 0.2 | 0.2 | 0.2 |
| NOx blowing test, properties of test oil | | | | | | | | | |
| acid number increase, mgKOH/g | after 72 h | 1 | 2.2 | 1.5 | 1.6 | 1 | 1.5 | 1.5 | 1.5 |
| | after 96 h | 5.5 | 7.6 | 2.2 | 2.8 | 2 | 2.1 | 2.2 | 2.3 |
| base number (HCL), mgKOH/g | after 72 h | 1.4 | 0.4 | 1.41 | 1.18 | 1.65 | 1.41 | 1.4 | 1.4 |
| | after 96 h | 0.7 | 0 | 0.8 | 0.8 | 0.8 | 0.7 | 0.8 | 0.7 |

| | Example 9 | Comparative Example 1 | Comparative Example 2 | Comparative Example 3 | Comparative Example 4 | Comparative Example 5 |
|---|---|---|---|---|---|---|
| Lubricating base oil 1) | balance | balance | balance | balance | balance | balance |
| (A)HALS1 2) | 0.5 | — | — | 0.5 | — | 0.5 |
| (A)HALS2 3) | — | — | — | — | — | — |
| (A)HALS3 4) | — | — | — | — | — | — |
| (B) molybdenum alkylphosphate 5) | 0.155 | — | — | — | — | — |
| (B) molybdenum alkyldithiophosphate 6) | — | — | 0.165 | — | 0.165 | — |
| (B) molybdenum dialkylamine salt 7) | — | — | | — | — | — |
| Amount as molybdenum | 0.015 | — | 0.015 | — | 0.015 | — |
| (C) hindered phenol compound 1 8) | 0.5 | 0.5 | 0.5 | 0.5 | 0.5 | 0.5 |
| (C) hindered phenol compound 2 9) | — | — | — | — | — | — |
| (D) zinc alkylphosphate 10) | — | — | — | — | 0.7 | 0.7 |
| Amount as phosphorus | — | — | — | — | 0.07 | 0.07 |
| zinc alkyldithiophosphate 11) | 1 | 1 | 1 | 1 | — | — |
| Amount as phosphorus | 0.07 | 0.07 | 0.07 | 0.07 | — | — |
| alkyldiphenylamine 12) | | 0.5 | — | — | 0.5 | — |
| metallic detergent 13) | 3.3 | 3.3 | 3.3 | 3.3 | 3.3 | 3.3 |
| ashless dispersant 14) | 5 | 5 | 5 | 5 | 5 | 5 |
| viscosity index improver 15) | 5 | 5 | 5 | 5 | 5 | 5 |
| Properties of composition | | | | | | |
| phosphorus content | 0.075 | 0.07 | 0.075 | 0.07 | 0.075 | 0.07 |
| Ca content | 0.2 | 0.2 | 0.2 | 0.2 | 0.2 | 0.2 |
| NOx blowing test, properties of test oil | | | | | | |
| acid number increase, mgKOH/g | 2 | 19.1 | 11.5 | 5.3 | 5.7 | 5.9 |
| | 4.8 | — | — | 24 | 22 | 15 |
| base number (HCL), mgKOH/g | 0.8 | 0 | 0 | 0.36 | 0.57 | 1.68 |
| | 0.3 | — | — | 0 | 0 | 0.7 |

1) hydrorefined mineral oil, total aromatic content: 0.0 mass %, sulfur content: <10 mass ppm, 100° C. kinematic viscosity: 4.0 $mm^2/s$, viscosity index: 120

2) HALS 1 HALS derivative from 2,2,4,8,10,10-hexamethylundecane-5-carboxylic acid, molecular weight: 423

3) HALS 2 HALS derivative from 2,2,4,8,10,10-hexamethylundecane-5-carboxylic acid, molecular weight: 437

4) HALS 3 HALS derivative from isostearic acid, molecular weight: 423

5) alkyl group: 2-ethylhexyl group, phosphorus content: 3.5 mass %, molybdenum content: 9.6 mass %

6) alkyl group: 2-ethylhexyl group, phosphorus content: 3.2 mass %, sulfur content: 10.1 mass %, molybdenum content: 9 mass %

7) alkyl group: carbon number 13, molybdenum content: 10.0 mass %

8) Irganox L-135 benzenepropanoic acid, 3,5-bis(1.1-dimethyl-ethyl)-4-hydroxy-, C7-C9 side chain alkyl ester 9) 4,4'-methylene bis(2,6-di-tert-butylphenol)

10) zinc di-n-hexylphosphate, phosphorus content: 10.4 mass %, zinc content: 10.8 mass %

11) alkyl group: secbutyl/hexyl group, phosphorus content: 7.2 mass %, sulfur content: 15.2 mass %, zinc content: 7.8 mass %

12) Irganox L-67 Dinonylated diphenylamine 13) calcium salicylate, total base number: 170 mgKOH/g, calcium content: 6.1 mass %

14) polybutenyl succinimide, number-average molecular weight of polybutenyl group: 1300

15) PMA SSI = 55 molecular weight 300,00-400000

TABLE 2

| | | Example 10 | Example 11 | Example 12 | Example 13 | Example 14 | Example 15 | Example 16 | Example 17 |
|---|---|---|---|---|---|---|---|---|---|
| Lubricating base oil 1) | | balance | balance | balance | balance | balance | balance | balance | balance |
| (A) HALS 1 2) | mass % | 0.5 | 0.5 | 0.5 | — | 0.5 | 0.5 | — | 0.5 |
| (A) HALS 2 3) | mass % | — | — | — | 0.5 | — | — | 0.5 | — |
| (B) tungsten DTC 4) | mass % | 0.215 | 0.215 | 0.215 | 0.215 | 0.215 | 0.215 | 0.215 | 0.215 |
| amount as tungsten | mass % | 0.03 | 0.03 | 0.03 | 0.03 | 0.03 | 0.03 | 0.03 | 0.03 |
| (C) hindered phenol compound 1 5) | mass % | — | — | 0.5 | 0.5 | 0.5 | — | — | — |
| (C) alkyldiphenylamine 6) | mass % | — | — | — | — | — | 0.5 | 0.5 | 0.5 |
| (D) zinc alkylphosphate 7) | mass % | 0.7 | — | 0.7 | 0.7 | — | 0.7 | 0.7 | — |
| amount as phosphorus | mass % | 0.07 | — | 0.07 | 0.07 | — | 0.07 | 0.07 | — |
| zinc alkyldithiophosphate 8) | mass % | — | 1 | — | — | 1 | — | — | 1 |
| amount as phosphorus | mass % | — | 0.07 | — | — | 0.07 | — | — | 0.07 |
| metallic detergent 9) | mass % | 3.3 | 3.3 | 3.3 | 3.3 | 3.3 | 3.3 | 3.3 | 3.3 |
| ashless dispersant 10) | mass % | 5 | 5 | 5 | 5 | 5 | 5 | 5 | 5 |
| viscosity index improver 11) | mass % | 5 | 5 | 5 | 5 | 5 | 5 | 5 | 5 |
| Properties of composition | | | | | | | | | |
| phosphorus content | mass % | 0.07 | 0.075 | 0.075 | 0.075 | 0.075 | 0.075 | 0.075 | 0.075 |
| Ca content | mass % | 0.2 | 0.2 | 0.2 | 0.2 | 0.2 | 0.2 | 0.2 | 0.2 |
| NOx blowing test, properties of test oil | | | | | | | | | |
| acid number increase, | after 72 h | 1 | 3.2 | 1 | 1 | 2.2 | 1 | 1 | 2.2 |
| mgKOH/g | after 96 h | 7.2 | 10.6 | 4.5 | 4.5 | 7.2 | 5.5 | 5.5 | 7.6 |
| base number (HCL), | after 72 h | 1.4 | 0.4 | 1.4 | 1.4 | 0.5 | 1.4 | 1.4 | 0.5 |
| mgKOH/g | after 96 h | 0.7 | 0 | 0.7 | 0.7 | 0 | 0.7 | 0.7 | 0 |

| | Example 18 | Comparative Example 1 | Comparative Example 3 | Comparative Example 5 | Comparative Example 6 | Comparative Example 7 |
|---|---|---|---|---|---|---|
| Lubricating base oil 1) | balance | balance | balance | balance | balance | balance |
| (A) HALS 1 2) | 0.5 | | — | 0.5 | — | 0.5 |
| (A) HALS 2 3) | — | — | — | — | — | — |
| (B) tungsten DTC 4) | 0.215 | — | 0.215 | — | 0.215 | — |
| amount as tungsten | 0.03 | — | 0.03 | — | 0.03 | — |
| (C) hindered phenol compound 1 5) | 0.5 | 0.5 | 0.5 | 0.5 | 0.5 | 0.5 |
| (C) alkyldiphenylamine 6) | 0.5 | 0.5 | | — | — | — |
| (D) zinc alkylphosphate 7) | 0.7 | — | — | — | 0.7 | 0.7 |
| amount as phosphorus | 0.07 | — | — | — | 0.07 | 0.07 |
| zinc alkyldithiophosphate 8) | — | 1 | 1 | 1 | — | — |
| amount as phosphorus | — | 0.07 | 0.07 | 0.07 | — | — |
| metallic detergent 9) | 3.3 | 3.3 | 3.3 | 3.3 | 3.3 | 3.3 |
| ashless dispersant 10) | 5 | 5 | 5 | 5 | 5 | 5 |
| viscosity index improver 11) | 5 | 5 | 5 | 5 | 5 | 5 |
| Properties of composition | | | | | | |
| phosphorus content | 0.075 | 0.07 | 0.075 | 0.07 | 0.075 | 0.07 |
| Ca content | 0.2 | 0.2 | 0.2 | 0.2 | 0.2 | 0.2 |
| NOx blowing test, properties of test oil | | | | | | |
| acid number increase, | 1.5 | 19.1 | 16.5 | 5.3 | 10.7 | 5.9 |
| mgKOH/g | 2.2 | — | — | 24 | 22 | 15 |
| base number (HCL), | 1.41 | 0 | 0 | 0.36 | 0.42 | 1.68 |
| mgKOH/g | 0.8 | — | — | 0 | 0 | 0.7 |

1) hydrorefined mineral oil, total aromatic content: 0.0 mass %, sulfur content: <10 mass ppm, 100° C. kinematic viscosity: 4.0 $mm^2/s$, viscosity index: 120
2) HALS 1 HALS derivative from 2,2,4,8,10,10-hexamethylundecane-5-carboxylic acid, molecular weight: 423
3) HALS 2 HALS derivative from 2,2,4,8,10,10-hexamethylundecane-5-carboxylic acid, molecular weight: 437
4) alkyl group: carbon number 13, sulfur content: 2.4 mass %, tungsten content: 14 mass %
5) Irganox L-135
6) Irganox L-67
7) zinc di-n-hexylphosphate, phosphorus content: 10.4 mass %, zinc content: 10.8 mass %
8) alkyl group: sec butyl/hexyl group, phosphorus content: 7.2 mass %, sulfur content: 15.2 mass %, zinc content: 7.8 mass %
9) calcium salicylate, total base number: 170 mgKOH/g, calcium content 6.1 mass %
10) polybutenyl succinimide, number-average molecular weight of polybutenyl group: 1300
11) PMA SSI = 55 molecular weight 300,00-400,000

Examples 19 to 26 and Comparative Examples 8 to 13

Lubricating oil compositions according to the present invention (Examples 19 to 26) and those for comparison (Comparative Examples 8 to 13) were prepared. A NOx blowing test was carried out for each of the compositions. The test was carried out under conditions where oxygen supplied at a flow rate of 115 ml/min was mixed with NO diluted with nitrogen (NO concentration: 800 ppm) supplied at a flow rate of 20 ml/min and then introduced in 150 g of a sample at an oil temperature of 140° C. The test time was set forth together with the results in Table 3.

For each of the compositions, the amount of eluted copper was measured at an oil temperature of 165.5° C. in accordance with JIS K 2514 4 (Lubricating oils for internal combustion engine-Determination of oxidation stability: ISOT) after 96 hours test time. The results are set forth in Table 1.

As apparent from the results set forth in Table 3, it is confirmed that the compositions of Examples 19 to 26 prevented lead from eluting in the NOx adsorbing test considerably more than those of Comparative Examples 8 to 13 and also significantly prevented copper from eluting in the ISOT test.

TABLE 3

| | | Example 19 | Example 20 | Example 21 | Example 22 | Example 23 | Example 24 | Example 25 | Example 26 |
|---|---|---|---|---|---|---|---|---|---|
| Lubricating base oil 1) | | balance | balance | balance | balance | balance | balance | balance | balance |
| (A) HALS 1 2) | mass % | 0.3 | 0.3 | 0.3 | 0.3 | — | | 0.3 | 0.3 |
| (A) HALS 2 3) | mass % | — | — | — | — | 0.3 | 0.3 | — | — |
| (B) molybdenum dithiocarbamate 4) | mass % | 0.15 | 0.15 | 0.15 | 0.15 | 0.15 | 0.15 | — | — |
| molybdenum alkylphosphate 5) | mass % | — | — | — | — | — | — | 0.155 | — |
| molybdenum dialkylamine salt 6) | mass % | — | — | — | — | — | — | — | 0.15 |
| amount as molybdenum | mass % | 0.015 | 0.015 | 0.015 | 0.015 | 0.015 | 0.015 | 0.015 | 0.015 |
| (C) hindered phenol compound 1 7) | mass % | — | 0.3 | | 0.3 | — | 0.3 | 0.3 | 0.3 |
| (C) alkyldiphenylamine 8) | mass % | — | — | 0.3 | — | — | — | — | — |
| zinc alkylphosphate 9) | mass % | 0.7 | 0.7 | 0.7 | 0.35 | 0.7 | 0.7 | 0.7 | 0.7 |
| amount as phosphorus | mass % | 0.07 | 0.07 | 0.07 | 0.035 | 0.07 | 0.07 | 0.07 | 0.07 |
| zinc alkyldithiophosphate 10) | mass % | — | — | — | 0.5 | — | — | — | — |
| amount as phosphorus | mass % | — | — | — | 0.035 | — | — | — | — |
| metallic detergent 11) | mass % | 3.3 | 3.3 | 3.3 | 3.3 | 3.3 | 3.3 | 3.3 | 3.3 |
| ashless dispersant 12) | mass % | 5 | 5 | 5 | 5 | 5 | 5 | 5 | 5 |
| viscosity index improver 13) | mass % | 5 | 5 | 5 | 5 | 5 | 5 | 5 | 5 |
| metal deactivator 14) | | — | — | — | — | — | — | — | — |
| Properties of composition | | | | | | | | | |
| phosphorus content | mass % | 0.07 | 0.07 | 0.07 | 0.07 | 0.07 | 0.07 | 0.075 | 0.07 |
| Mo content | mass % | 0.015 | 0.015 | 0.015 | 0.015 | 0.015 | 0.015 | 0.015 | 0.015 |
| Ca content | mass % | 0.2 | 0.2 | 0.2 | 0.2 | 0.2 | 0.2 | 0.2 | 0.2 |
| Pb amount after Nox absorbing test (140° C.) mass % | after 72 h | 82 | 56 | 53 | 88 | 95 | 50 | 120 | 117 |
| Cu amount by ISOT (165° C.) mass % | after 96 h | 12 | 5 | 5 | 32 | 15 | 4 | 35 | 40 |

| | Comparative Example 8 | Comparative Example 9 | Comparative Example 10 | Comparative Example 11 | Comparative Example 12 | Comparative Example 13 |
|---|---|---|---|---|---|---|
| Lubricating base oil 1) | balance | balance | balance | balance | balance | balance |
| (A) HALS 1 2) | 0.3 | — | 0.3 | 0.3 | — | 0.3 |
| (A) HALS 2 3) | — | — | — | — | — | — |
| (B) molybdenum dithiocarbamate 4) | — | 0.15 | — | — | — | 0.5 |
| molybdenum alkylphosphate 5) | — | — | 0.155 | — | — | — |
| molybdenum dialkylamine salt 6) | — | — | — | 0.15 | — | — |
| amount as molybdenum | — | 0.015 | 0.015 | 0.015 | — | 0.05 |
| (C) hindered phenol compound 1 7) | — | — | — | — | — | — |
| (C) alkyldiphenylamine 8) | — | — | — | — | — | — |
| zinc alkylphosphate 9) | 0.7 | 0.7 | 0.7 | 0.7 | — | 0.7 |
| amount as phosphorus | 0.07 | 0.07 | 0.07 | 0.07 | — | 0.07 |
| zinc alkyldithiophosphate 10) | — | — | — | — | 1 | — |
| amount as phosphorus | — | — | — | — | 0.07 | — |
| metallic detergent 11) | 3.3 | 3.3 | 3.3 | 3.3 | 3.3 | 3.3 |
| ashless dispersant 12) | 5 | 5 | 5 | 5 | 5 | 5 |
| viscosity index improver 13) | 5 | 5 | 5 | 5 | 5 | 5 |
| metal deactivator 14) | — | — | — | — | 0.03 | — |
| Properties of composition | | | | | | |
| phosphorus content | 0.07 | 0.075 | 0.075 | 0.07 | 0.075 | 0.075 |
| Mo content | — | 0.015 | 0.015 | 0.015 | — | 0.015 |
| Ca content | 0.2 | 0.2 | 0.2 | 0.2 | 0.2 | 0.2 |

TABLE 3-continued

| | | | | | | |
|---|---|---|---|---|---|---|
| Pb amount after Nox absorbing test (140° C.) mass % | 350 | 650 | 150 | 144 | 340 | 125 |
| Cu amount by ISOT (165° C.) mass % | 240 | 57 | 1000 | 1100 | 78 | 120 |

1) hydrorefined mineral oil, total aromatic content: 0.0 mass %, sulfur content: <10 mass ppm, 100° C. kinematic viscosity: 4.0 $mm^2/s$, viscosity index: 120
2) HALS 1 HALS derivative from 2,2,4,8,10,10-hexamethylundecane-5-carboxylic acid, molecular weight: 423
3) HALS 2 HALS derivative from 2,2,4,8,10,10-hexamethylundecane-5-carboxylic acid, molecular weight: 437
4) alkyl group: 2-ethylhexyl group, molybdenum content: 10 mass %
5) alkyl group: 2-ethylhexyl group, phosphorus content: 3.5 mass %, molybdenum content: 9.6 mass %
6) alkyl group: carbon number 13, molybdenum content: 10.0 mass %
7) Irganox L-135
8) Irganox L-64
9) zinc di-n-hexylphosphate, phosphorus content: 10.4 mass %, zinc content: 10.8 mass %
10) alkyl group: sec butyl/hexyl group, phosphorus content: 7.2 mass %, sulfur content: 15.2 mass %, zinc content: 7.8 mass %
11) calcium salicylate, total base number 170 mgKOH/g, calcium content: 6.3 mass %
12) polybutenyl succinimide, number-average molecular weight of polybutenyl group: 1300
13) PMA SSI = 55 molecular weight 300,00-400,000
14) 1-[N,N-bis(2-ethylhexyl)aminomethyl]benzotriazole

INDUSTRIAL APPLICABILITY

The lubricating oil composition of the present invention is generally used as a lubricating oil required to have oxidation stability and detergency, and may be also used as a gear oil for transmissions or final reduction gears of automobiles and also suitably used for internal combustion engines such as gasoline engines, diesel engines and gas engines for two- and four-wheeled vehicles, power generators and cogenerations and also various engines of ships and outboard motors. The method for lubrication of the present invention using a specific lubricating oil composition selected from the lubricating oil compositions of the present invention can prevent elution of both copper and lead and thus particularly useful for an internal combustion engine having copper- and/or lead-containing sliding materials.

The invention claimed is:

1. A lubricating oil composition comprising a lubricating base oil, (A) a 2,2,6,6-tetraalkylpiperidine derivative selected from HALS1, HALS2, and HALS3

HALS1

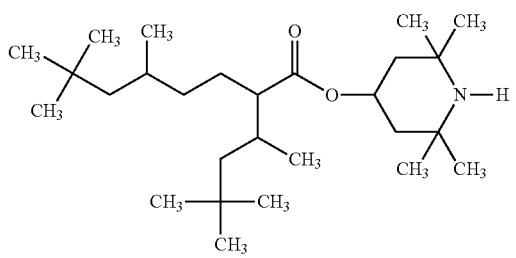

HALS2

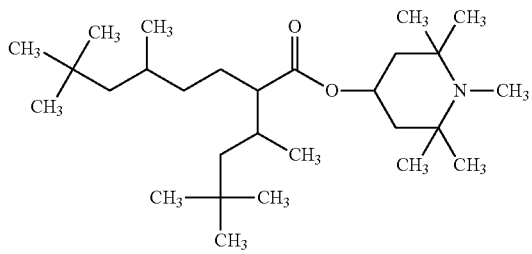

-continued

HALS3

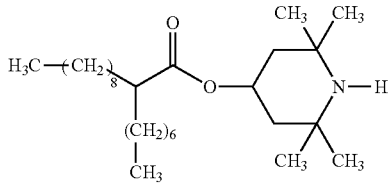

and (B) an organic molybdenum compound and/or an organic tungsten compound.

2. The lubricating oil composition according to claim 1 further comprising (C) a hindered phenol-type anti-oxidant and/or an aromatic amine-type anti-oxidant.

3. The lubricating oil composition according to claim 1 further comprising (D) at least one type of compound selected from the group consisting of phosphorus compounds represented by formula (1) and metal salts or amine salts thereof in an amount of 0.005 to 0.5 percent by mass as phosphorus:

(1)

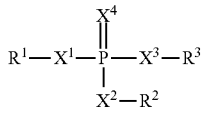

wherein $X_1$, $X_2$, $X_3$ and $X_4$ are each independently oxygen or sulfur and at least two of them are oxygen and $R_1$, $R_2$ and $R_3$ are each independently hydrogen or a hydrocarbon group having 1 to 30 carbon atoms.

4. The lubricating oil composition according to claim 3 wherein Component (D) is a sulfur-free phosphorus acid ester metal salt represented by formula (2) and/or formula (3):

(2)

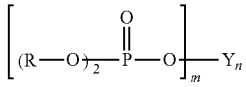

-continued (3)

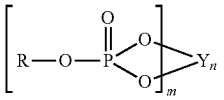

wherein Rs are each an alkyl or aryl group having 1 to 30 carbon atoms and may be the same or different from each other, Y is metal excluding alkali metal, and m and n are each independently an integer of 1 to 4.

5. A method for lubricating a sliding material while preventing elution of the copper and/or lead contained in the material, comprising contacting a lubricating oil composition comprising a lubricating base oil, (A) a 2,2,6,6-tetraalkylpiperidine derivative selected from HALS1, HALS2, and HALS3:

HALS1

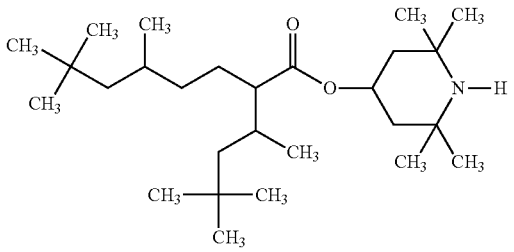

HALS2

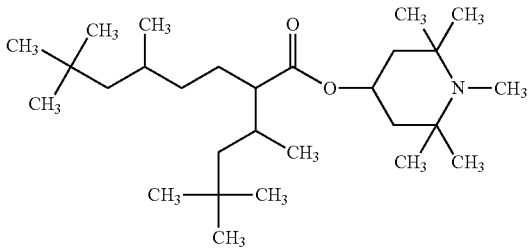

HALS3

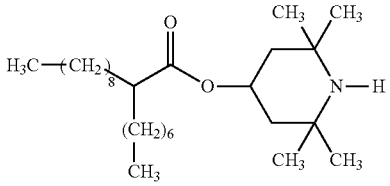

(B) an organic molybdenum compound in an amount of 30 to 300 ppm by mass as molybdenum and (C) a hindered phenol-type anti-oxidant and/or an aromatic amine-type anti-oxidant with a copper- and/or lead-containing sliding material.

6. The method for lubrication according to claim 5 wherein the lubricating oil composition further comprises (D) at least one type of compound selected from the group consisting of phosphorus compounds represented by formula (1) and metal salts or amine salts thereof in an amount of 0.005 to 0.5 percent by mass as phosphorus:

(1)

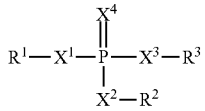

wherein $X^1$, $X^2$, $X^3$ and $X^4$ are each independently oxygen or sulfur and at least two of them are oxygen and $R^1$, $R^2$ and $R^3$ are each independently hydrogen or a hydrocarbon group having 1 to 30 carbon atoms.

7. The method for lubrication according to claim 6 wherein Component (D) is a sulfur-free phosphorus acid ester metal salt represented by formula (2) and/or formula (3):

(2)

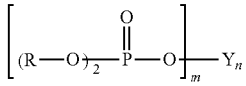

(3)

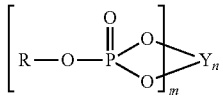

wherein Rs are each an alkyl or aryl group having 1 to 30 carbon atoms and may be the same or different from each other, Y is metal excluding alkali metal, and m and n are each independently an integer of 1 to 4.

8. The method for lubrication according claim 5 wherein the lubricating oil composition is used in an internal combustion engine where copper- and/or lead-containing sliding materials are used.

9. The lubricating oil composition according to claim 2 further comprising (D) at least one type of compound selected from the group consisting of phosphorus compounds represented by formula (1) and metal salts or amine salts thereof in an amount of 0.005 to 0.5 percent by mass as phosphorus:

(1)

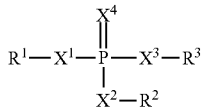

wherein $X_1$, $X_2$, $X_3$ and $X_4$ are each independently oxygen or sulfur and at least two of them are oxygen and $R_1$, $R_2$ and $R_3$ are each independently hydrogen or a hydrocarbon group having 1 to 30 carbon atoms.

* * * * *